US008028556B2

(12) United States Patent
Brown

(10) Patent No.: US 8,028,556 B2
(45) Date of Patent: Oct. 4, 2011

(54) KEY RING WITH TAMPER-EVIDENT CLOSURE MEMBER, KIT FOR ASSEMBLING A KEY RING, AND METHOD OF USING SAME

(76) Inventor: Robert Alan Brown, Colbert, WA (US)

( * ) Notice: Subject to any disclaimer, the term of this patent is extended or adjusted under 35 U.S.C. 154(b) by 0 days.

(21) Appl. No.: 12/795,944

(22) Filed: Jun. 8, 2010

(65) Prior Publication Data

US 2010/0307209 A1 Dec. 9, 2010

Related U.S. Application Data

(60) Provisional application No. 61/185,320, filed on Jun. 9, 2009.

(51) Int. Cl.
*A44B 15/00* (2006.01)

(52) U.S. Cl. ..... 70/456 R; 70/458; 70/459; 292/307 R

(58) Field of Classification Search ..... 70/456 R–459; 292/307 R
See application file for complete search history.

(56) References Cited

U.S. PATENT DOCUMENTS

| | | | | | |
|---|---|---|---|---|---|
| 765,823 | A | * | 7/1904 | Erb | 119/863 |
| 1,132,970 | A | | 3/1915 | Peyton | |
| 1,172,374 | A | | 2/1916 | Leimer | |
| 1,682,396 | A | * | 8/1928 | Miller | 292/318 |
| 1,792,575 | A | | 2/1931 | D'Ewart | |
| 2,771,768 | A | | 11/1956 | Tudor | |
| 4,929,006 | A | | 5/1990 | Tsay | |
| 4,991,889 | A | | 2/1991 | Remark | |
| 5,138,855 | A | | 8/1992 | Faris | |
| 5,226,809 | A | | 7/1993 | Franco | |
| 5,794,993 | A | | 8/1998 | Eckerdt | |
| 6,146,049 | A | * | 11/2000 | Faris | 403/326 |

* cited by examiner

*Primary Examiner* — Suzanne Barrett
(74) *Attorney, Agent, or Firm* — Carrier Blackman & Associates, P.C.; William D. Blackman; Joseph P. Carrier

(57) ABSTRACT

A key ring apparatus is designed to provide visual evidence of tampering. The key ring apparatus includes a main loop member having adjacent end portions with substantially equal diameters. The key ring apparatus also includes a hollow tubular sleeve that receives the main loop end portions, and is crimped into place thereon after keys have been placed on the main loop member. The tubular sleeve may have a pair of crimping indication indicators thereon, to show where to crimp the sleeve onto the main loop of the key ring apparatus. One or both of the main loop member and the sleeve may have a unique serial identification number thereon.

20 Claims, 11 Drawing Sheets

KEY RING WITH TAMPER-EVIDENT CLOSURE MEMBER, KIT FOR ASSEMBLING A KEY RING, AND METHOD OF USING SAME

CROSS-REFERENCE TO RELATED APPLICATIONS

The present application claims priority under 35 U.S.C. 119(e), based on U.S. provisional patent application 61/185,320, filed 9 Jun. 2009. The entire disclosure of this priority document, including the specification and drawings, is incorporated by reference herein.

BACKGROUND OF THE INVENTION

1. Field of the Invention

The present invention relates to key rings. More particularly, the present invention relates to a key ring having a tamper-evident closure member and a unique alphanumeric serial identification code, as well as to kit for assembling a high-security key ring, and a method of using the described kit to form a key ring.

2. Description of the Background Art

A number of different key rings are known for storing various keys.

Examples of some of the known key rings include those described in U.S. Pat. No. 5,794,993 to Eckerdt, and also in each of the references cited in the file history of U.S. Pat. No. 5,794,993.

Although the known devices have some utility for their intended purposes, a need still exists in the art for an improved tamper-evident key ring.

SUMMARY OF THE INVENTION

The present invention provides a key ring apparatus which is configured to provide visual evidence of tampering, in the event that tampering occurs. The key ring is intended for use with high-security applications, where it is necessary that visual evidence of tampering is irreparably shown if any keys are removed from the key ring.

A key ring according to an illustrative embodiment of the invention includes a main loop member including first and second end portions having substantially equal diameters, and having an open space therebetween. Each of the first and second end portions has a respective annular groove formed therearound, and a respective alignment mark formed thereon adjacent the groove.

Optionally, the key ring hereof may include a spacer having a diameter which is substantially equal to the diameters of the first and second end portions. Where used, the spacer is formed in a size which is configured to fit into the open space between the first and second end portions of the main loop member.

The key ring according to the illustrative embodiment hereof also includes a tubular sleeve member having a hollow passage formed therethrough to receive the end portions of the main loop member. The tubular sleeve is also formed to accept the spacer therein if the spacer is used. The tubular sleeve has a pair of crimping location indicators thereon to suggest crimping areas for applying a crimping tool thereto. The tubular sleeve may also have a unique serial ID number engraved thereon, if desired. When the sleeve member is slidably installed on the main loop member, the ends of the sleeve member are alignable with the alignment marks to correspondingly align the indicators of the sleeve member with the underlying grooves of the main loop member.

The present invention also provides a method of fixing a key on a key ring, which is configured to provide visual evidence of tampering, in the event that tampering occurs.

In one example of an illustrative method, a first step involves mounting a key on a main loop member including a first end portion having a first diameter and a second end portion disposed adjacent the first end portion with an open space therebetween, the second end portion having a diameter which is substantially equal to the first diameter, and each of the first and second end portions having a respective groove formed therein.

A second step of the illustrative method involves sliding a tubular sleeve member having a hollow passage formed therethrough on to one of the first and second end portions of the main loop member, and slidably moving the sleeve member away from the open space between the end portions of the main loop, the tubular sleeve having a pair of crimping location indicators thereon to suggest crimping areas for applying a crimping tool thereto.

Another step of the illustrative method involves placing a spacer which has a diameter which is substantially equal to the first diameter into the open space between the first and second end portions of the main loop member.

Another step of the illustrative method involves slidably moving the sleeve member to cover the spacer and the end portions of the main loop member.

Still another step of the illustrative method involves making a respective indentation in each area of the sleeve member having a crimping location indicator thereon; and this step may involve pressing a first of the indentations toward a corresponding groove formed in the first end portion of the main loop member, and pressing a second of the indentations toward a corresponding groove formed in the second end portion of the main loop member, in order to firmly connect the sleeve member to the main loop member and so that at least one area of the key ring will be visually marked by subsequent separation of the sleeve member from either of the two end portions, in the event that such subsequent separation occurs.

Accordingly, it is an object of the present invention to provide a method and apparatus for clearly, visually indicating whether or not tampering has occurred on a high-security key ring.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

Figure 1:
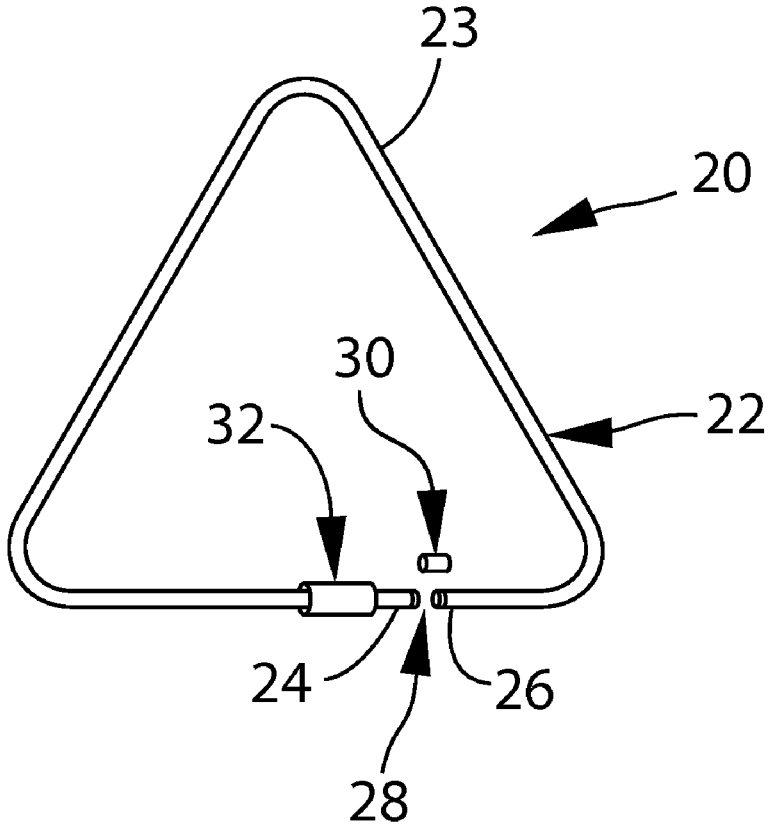
FIG. 1 is a plan view of a key ring according to a first illustrative embodiment of the invention, shown in a non-assembled configuration.

Descriptions of illustrative key rings and kits for assembling to form key rings according to a number of selected illustrative embodiments of the present invention are provided below, on a basis of an example of the present invention, supported by and shown in the accompanying drawings. It should be understood that only structures considered necessary for clarifying the present invention are described herein. Other conventional structures, and those of ancillary and auxiliary components of the system, will be known and understood by those skilled in the art. In the following detailed description, relative positional terms such as "top", "bottom", "right side" and "left side" correspond to those directions as seen in the drawings, and are meant to illustrate the depicted embodiment, rather than to limit the invention.

First Embodiment

Figure 2:
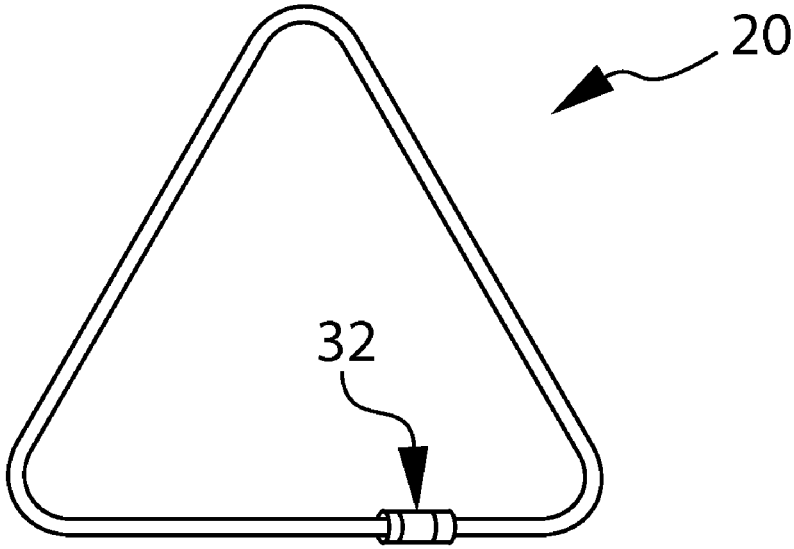
FIG. 2 is a plan view of the key ring of FIG. 1, shown in an assembled and crimped configuration.

A key ring assembly according to a first illustrative embodiment of the present invention is shown generally at 20 in FIGS. 1 and 2 of the drawings, and is also referred to as a key ring 20 herein. The key ring 20 is configured to provide visual evidence of tampering in the event that tampering occurs. The key ring 20 is intended for use with high-security applications where visual evidence of tampering is irreparably shown if any keys are removed from the key ring.

All components of the key ring 20 are formed from a strong, durable material, which may be stainless steel, another strong metal, or a high-tech tamper-resistant plastic. Optionally, but not necessarily, selected portions of the key ring 20 may be formed from a high-strength braided wire.

Figure 3A:
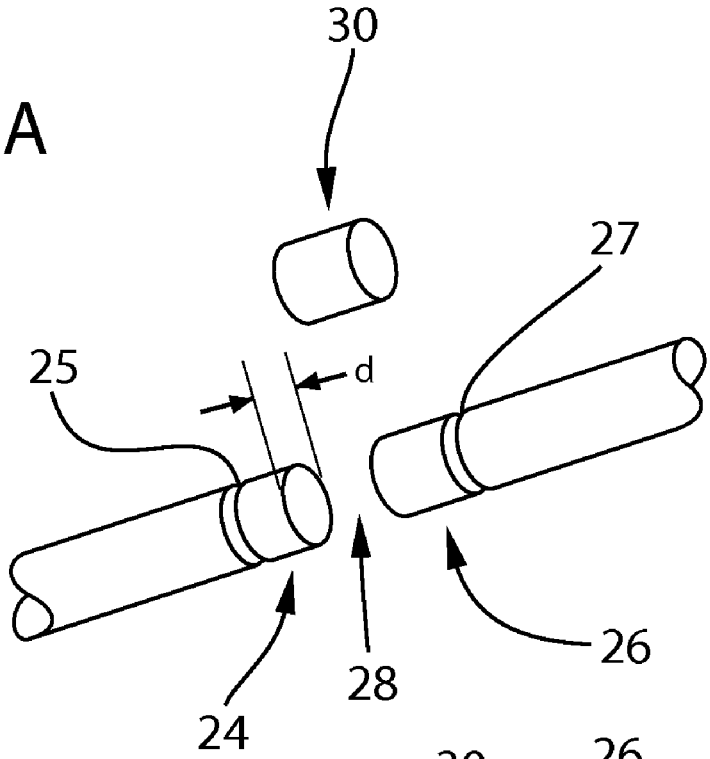
FIG. 3A is an enlarged detail view of a closure portion of the key ring of FIGS. 1-2, shown in a non-assembled configuration.
Figure 3B:
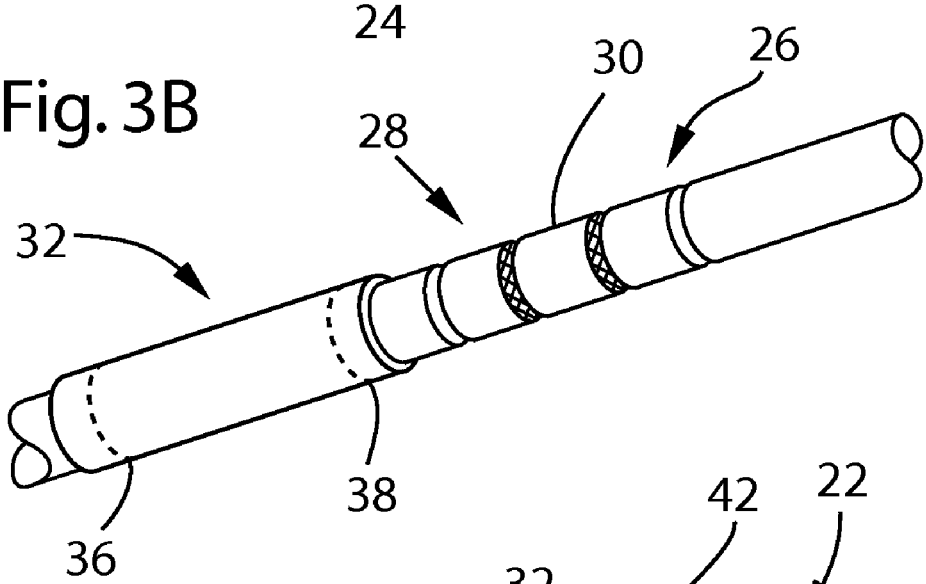
FIG. 3B is an enlarged detail view of the closure portion of FIG. 3A, shown in an intermediate assembly step.
Figure 3D:
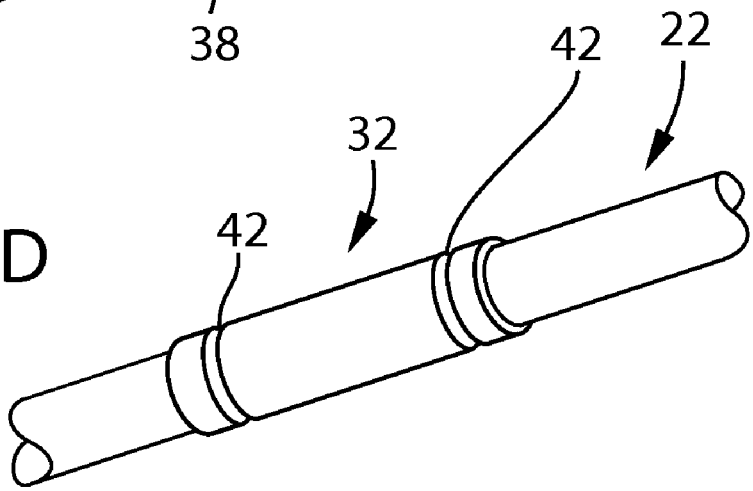
FIG. 3D is an enlarged detail view of the closure portion of FIG. 3A, shown in an assembled and crimped configuration.

The key ring 20 of the first embodiment includes a main loop member 22 including a first end portion 24 having a first diameter "d" (FIG. 3A). The main loop member 22 also includes a second end portion 26 disposed adjacent the first end portion 24 and arranged such that an open space 28 is provided between the first and second end portions 24, 26. The second end portion has a diameter which is substantially equal to the first diameter "d". The main loop member 22 also includes an intermediate portion 23 extending between and interconnecting the end portions 24, 26. Each of the first and second end portions 24, 26 is formed from a rigid, high-strength material.

The main loop member 22 may be formed from a single piece of material such as, e.g., a high-strength one-piece metal ring. Alternatively, the main loop member may be formed from a combination of materials, such as solid metal for the end portions 24, 26 interconnected by an intermediate portion 23, formed from high-strength braided wire, and which is integrally and substantially permanently attached to the end portions.

Each of the first and second end portions 24, 26 has a respective groove 25, 27 formed therein, as shown in FIG. 3A. The grooves may either be formed in only a portion of the first and second end portions 24, 26, or alternatively, if desired, the grooves 25, 27 may extend circumferentially all of the way around each of the first and second end portions 24, 26, respectively.

Although the main loop member 22 is shown in a substantially triangular outline shape in FIGS. 1-2, it will be understood that the main loop member may be substantially circular as shown in FIGS. 7 and 10, rectangular or oval in shape, or may be formed in any other preferred outline shape without departing from the present invention.

In the first embodiment thereof, the key ring 20 may also include an optional spacer 30, which also has a diameter that is substantially equal to the first diameter "d". The spacer 30, where used, is formed having a length that is configured to fit into the open space 28 between the first and second end portions 24, 26 of the main loop member 22.

The key ring 20 also includes a tubular sleeve member 32 having a hollow passage 34 formed therethrough to receive the spacer 30 and the end portions of the main loop member 22. The tubular sleeve has a pair of crimping location indicators 36, 38 thereon to suggest crimping areas for applying a working end of a crimping tool 100 (shown in FIG. 3C) thereto.

Figure 3C:
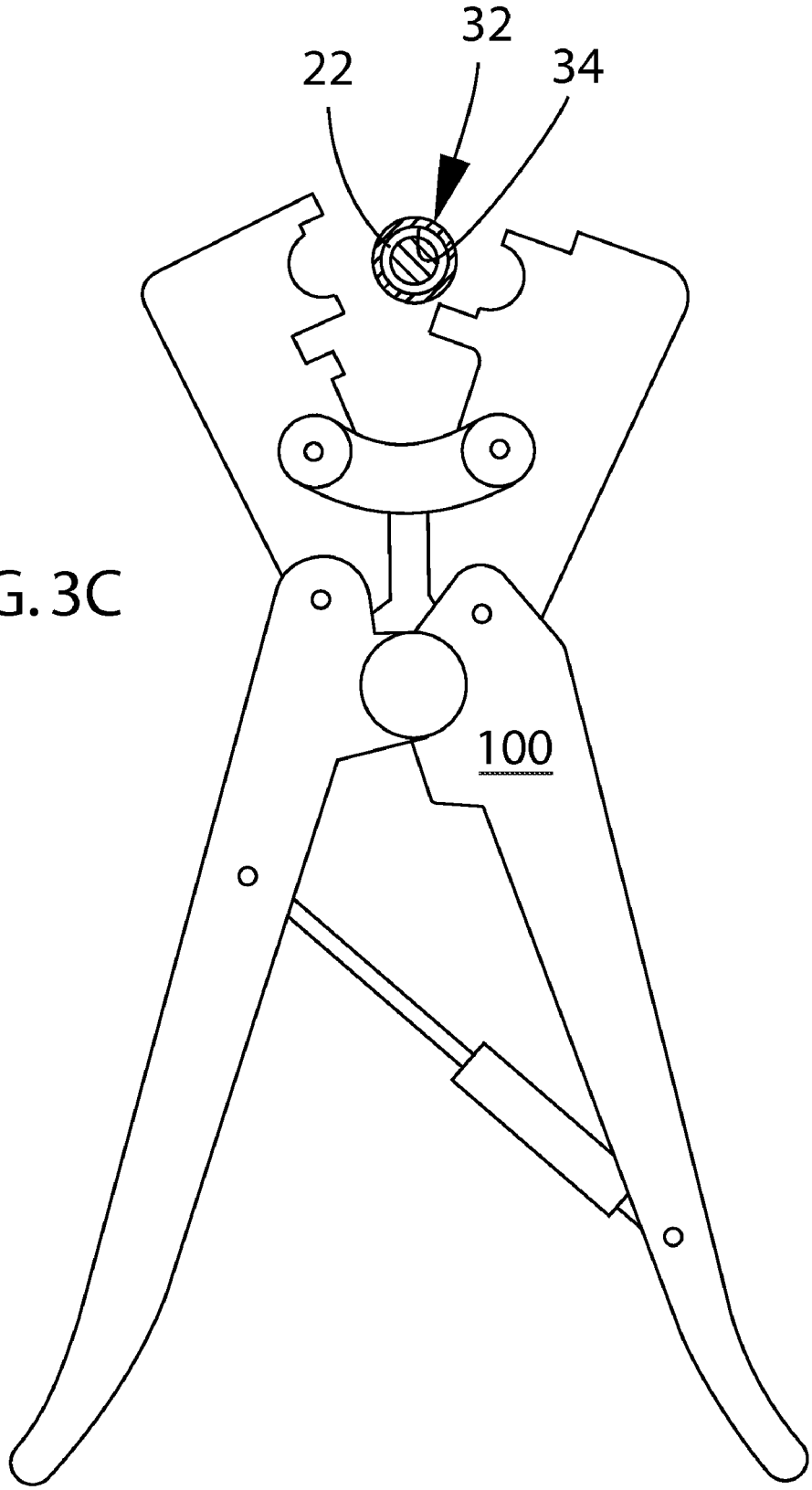
FIG. 3C is a plan view of a crimping tool usable in practicing the method hereof, with the key ring shown in cross-section.

When assembling the key ring 20, any keys to be used are installed on the main loop member. Then, the crimping location indicators 36, 38 are aligned with the grooves 25, 27 and a crimping tool 100 is used to crimp and compress the sleeve 32 in place on to the main loop member 22, as shown in FIG. 3C, at each of the first and second end portions 24, 26.

This crimping operation substantially permanently affixes the sleeve in place on the main loop member, in such a manner that if tools are used to forcibly move the sleeve 32 to one side, in order to remove one or more keys from the ring, tool marks will be permanently and irreversibly made on the sleeve 32, alerting a user that tampering has occurred.

Figure 4:
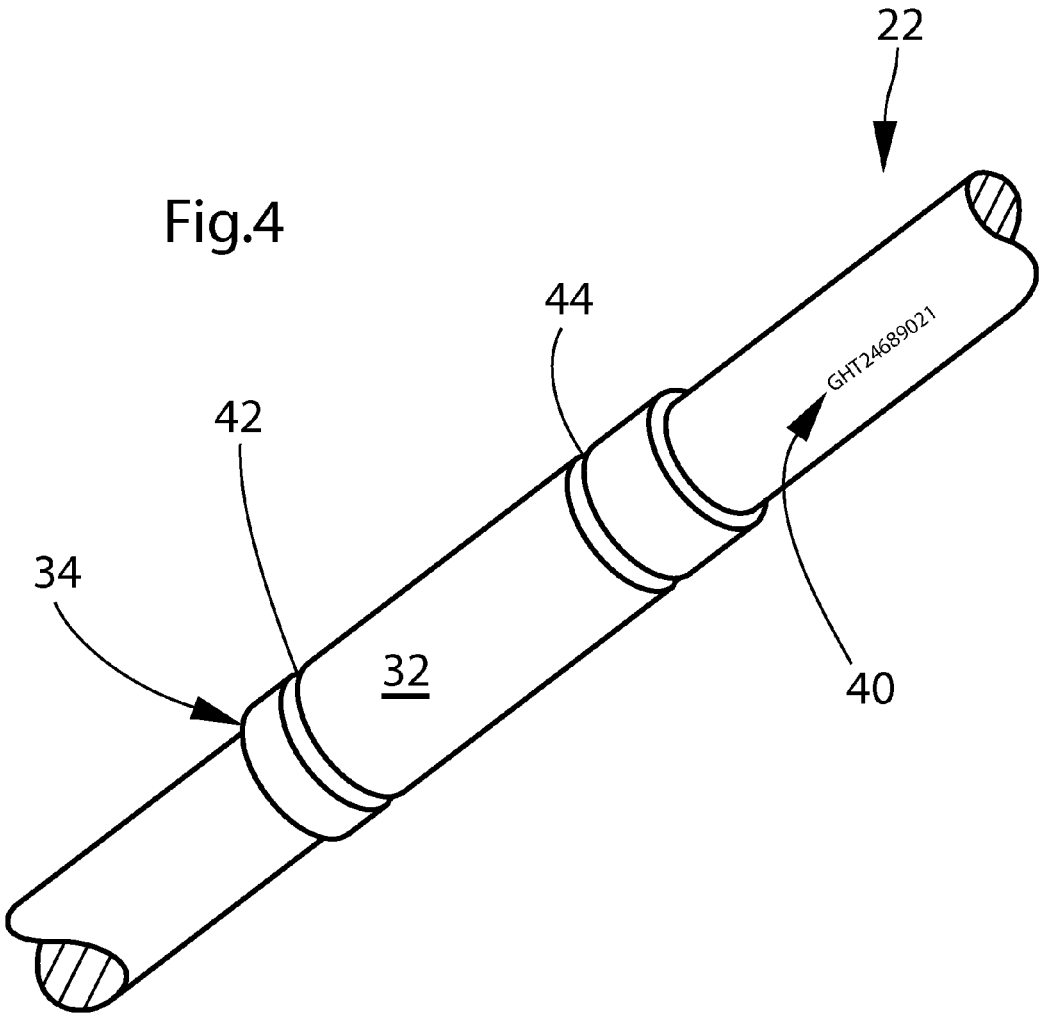
FIG. 4 is an enlarged detail view of the closure portion of FIG. 3C, showing a laser-engraved serial number on the key ring.

Referring now to FIG. 4, it will be seen that a unique serial ID number 40 may be stamped in, laser-etched on to, or otherwise applied to the key ring 20, if desired. Where used, the serial ID number 40 may be placed either on the sleeve 32, on the main loop member 22, or on both of these components.

Second Embodiment

Referring now to FIGS. 7A-7B and 8A-8B, a key ring apparatus 120 according to a second embodiment of the present invention is shown, and is also referred to as a key ring 120 herein. The key ring 120 according to the second embodiment is substantially identical to the key ring 20 according to the first embodiment, except as specifically described herein.

In this second embodiment, the spacer is not shown in the drawings. However, if desired, a spacer similar to that shown at 30 may be used with the second embodiment.

The key ring 120 is configured to provide visual evidence of tampering in the event that tampering occurs. The key ring 120 is intended for use with high-security applications where visual evidence of tampering is irreparably shown if any keys are removed from the key ring.

All components of the key ring 120 are formed from a strong, durable material, which may be stainless steel, another strong metal, or a high-tech tamper-resistant plastic. Optionally, but not necessarily, selected portions of the key ring 120 may be formed from a high-strength braided wire.

The key ring 120 of the second embodiment includes a main loop member 122 including a first end portion 124 having a first diameter, similar to the diameter "d" shown in FIG. 3A. The main loop member 122 also includes a second end portion 126 disposed adjacent the first end portion 124 and arranged such that an open space 128 is provided between the first and second end portions 124, 126. The second end portion 126 has a diameter which is substantially equal to the first diameter "d". The main loop member 122 also includes an intermediate portion 123 extending between and interconnecting the end portions 124, 126. Each of the first and second end portions 124, 126 is formed from a rigid, high-strength material.

In the second embodiment of the key ring 120, each of the first and second end portions 124, 126 includes a substantially straight part, as shown, and which extends substantially linearly so as to correspond to the straight tubular shape of the sleeve 132 which will be received thereon. It will be noted that the straight part 124*s* of the first end portion 124 is significantly longer than the straight part 126*s* of the second end portion 126, in order to permit the sleeve to be slidably installed thereon and moved on to the first end portion past the open space 128, so that a user may install one or more keys on the main loop member 122, before the sleeve 132 is slid back over to cover the space 128 and is then, subsequently, crimped in place on the main loop member. If desired, the straight part 124*s* may be made even longer than that shown in FIGS. 7B-7C, so that the main loop member 122 is made substantially D-shaped.

The main loop member 122 may be formed from a single piece of material such as, e.g., from a single high-strength machined piece of metal rod or ring. Alternatively, the main loop member may be formed from a combination of materials, such as solid metal for each of the respective end portions 124, 126, interconnected by an intermediate portion 123 formed from high-strength braided wire, and which is integrally and substantially permanently attached to each of the end portions.

Figure 7A:
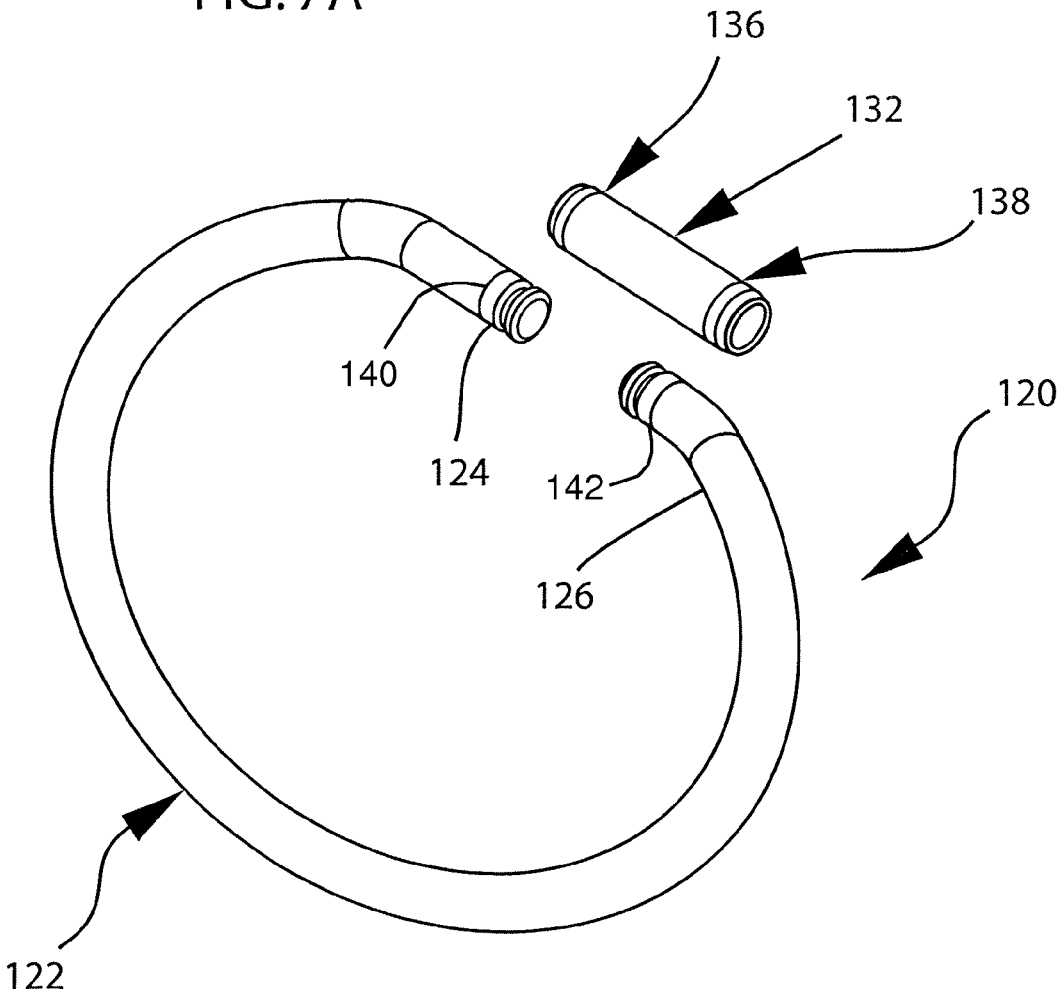
FIG. 7A is a perspective view of a key ring and sleeve according to a second embodiment hereof, shown in a non-assembled configuration.
Figure 7B:
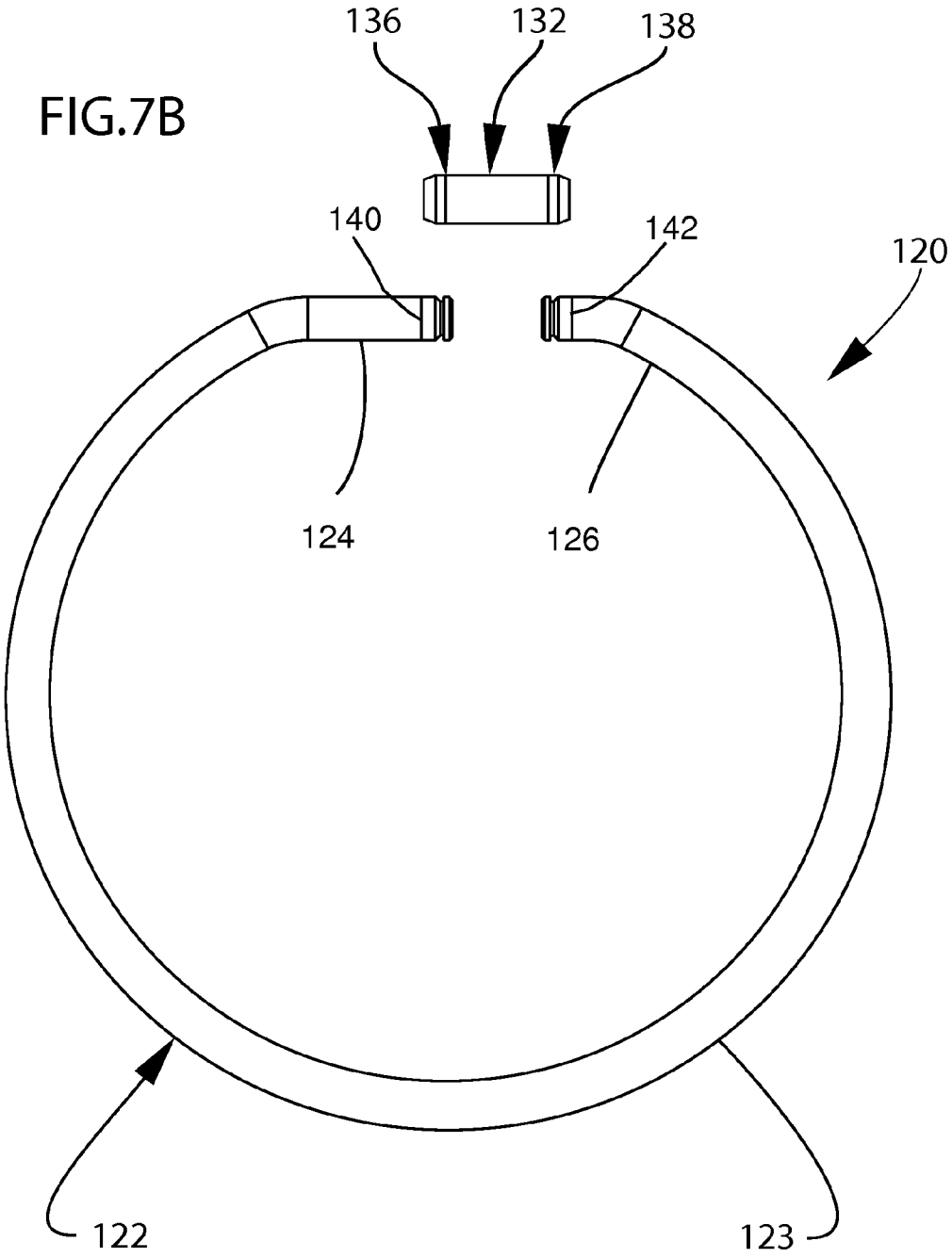
FIG. 7B is a front plan view of the key ring of FIG. 7A.
Figure 7C:
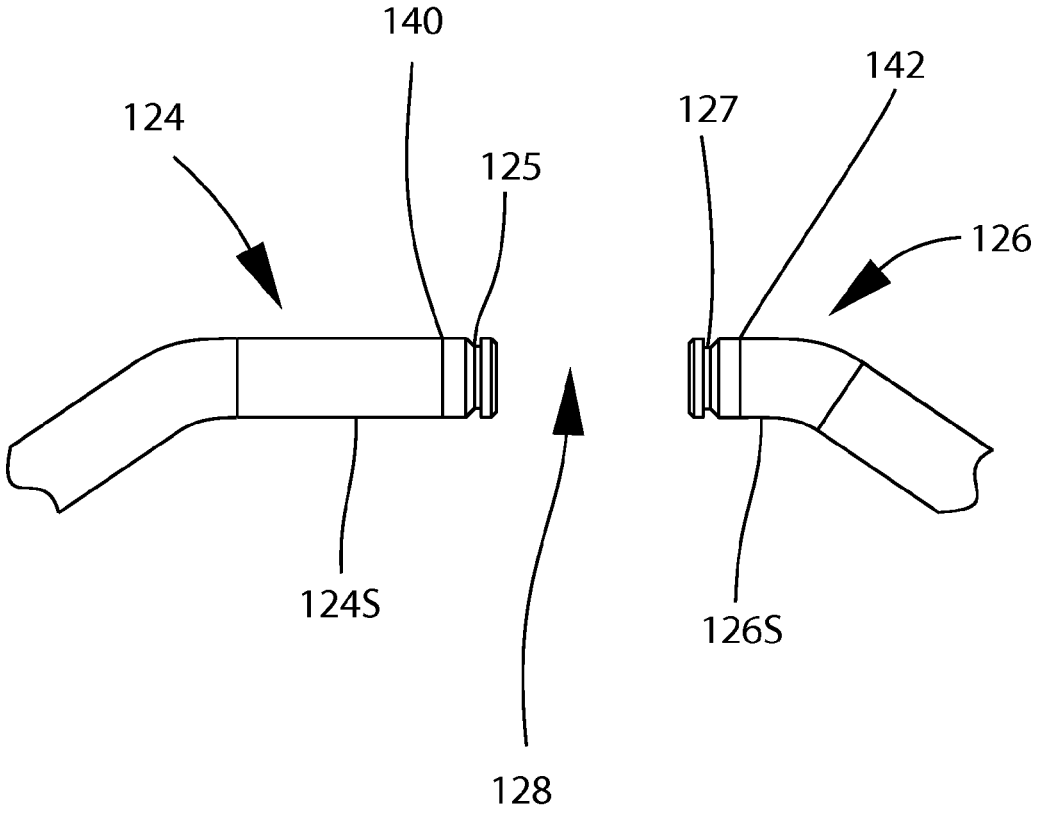
FIG. 7C is a fragmentary detail view of a closure portion of the main loop member, which is a component of the key ring of FIGS. 7A-7B.
Figure 8A:
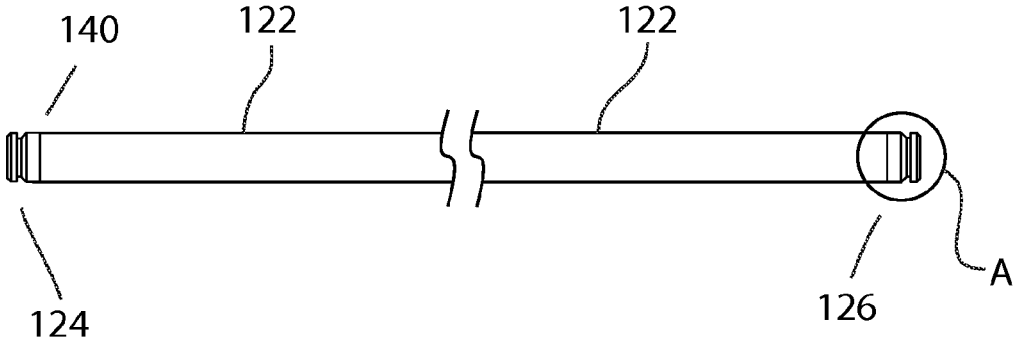
FIG. 8A is a plan view, partially cut away, of a machined rod which is usable to form into the key ring of FIGS. 7A-7B.
Figure 8B:
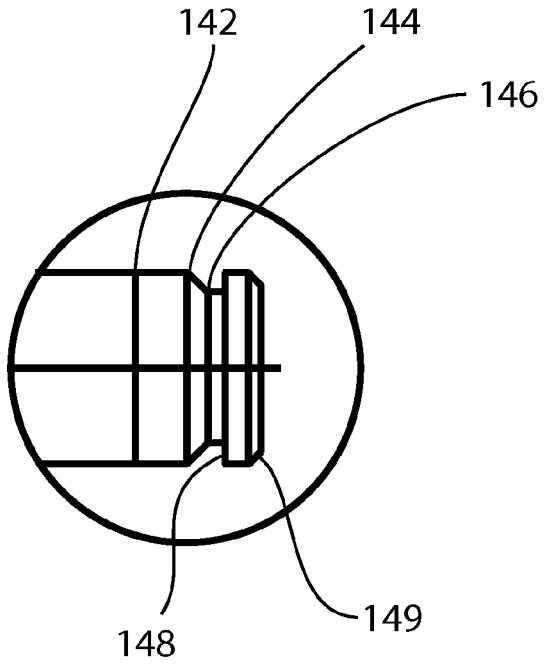
FIG. 8B is a detail plan view of an end portion of the key ring of FIGS. 7A-7B.
Figure 9A:
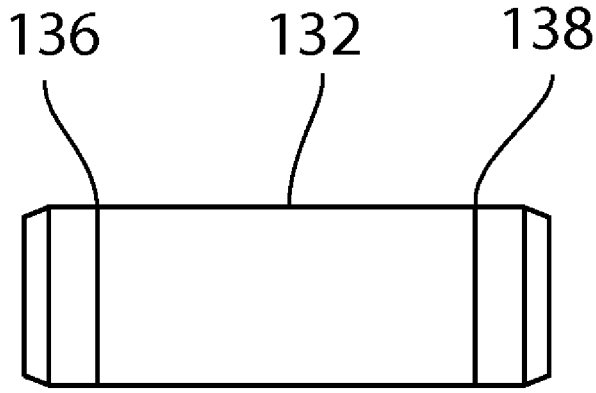
FIG. 9A is a plan view of a tubular sleeve member which is a component of the key ring of FIGS. 7A-7B.
Figure 9B:
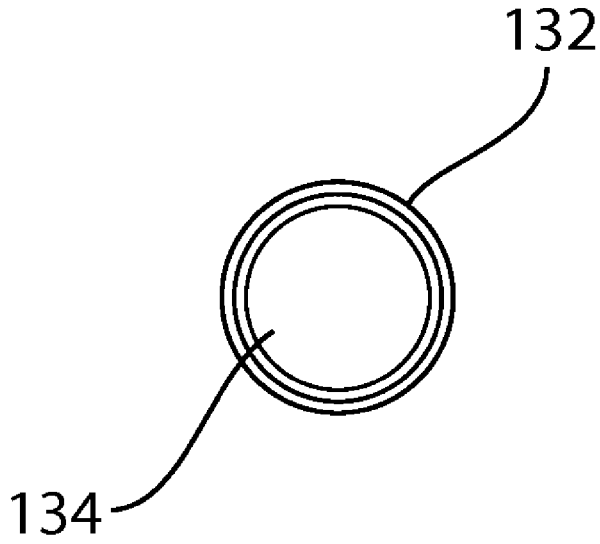
FIG. 9B is an end plan view of the tubular sleeve member of FIG. 9A.

Each of the first and second end portions 124, 126 has a respective groove 125, 127 formed therein, as shown in FIG. 7C. The grooves 125, 127 may either be formed in only a portion of the first and second end portions 124, 126, or alternatively, if desired, the grooves 125, 127 may extend circumferentially all of the way around each of the first and second end portions 124, 126, respectively.

Although the main loop member 122 is shown in a substantially round outline shape in FIGS. 1-2, aside from the straight parts 124*s*, 126*s*, it will be understood that the main loop member 122 may be rectangular or oval in shape, or may be formed in any other preferred outline shape without departing from the present invention.

The key ring 120 according to the second embodiment also includes a tubular sleeve member 132 having a hollow passage 134 formed therethrough to receive the respective end portions of the main loop member 122. The tubular sleeve member 132 has a pair of crimping location indicators 136, 138 thereon to suggest crimping areas for applying a working end of a crimping tool 100 (shown in FIG. 3C) thereto.

When assembling the key ring 120, the straight part 124*s* of the first end portion 124 is inserted into and through the sleeve member 132 as far as possible, to expose the open space 128. Then, any keys to be used are installed on the main loop member. Then, the crimping location indicators 136, 138 are aligned with the grooves 125, 127, and a crimping tool 100 is used to crimp and compress the sleeve member 132 in place on the main loop member 22, as shown in FIG. 3C, at each of the first and second end portions 124, 126.

This crimping operation substantially permanently affixes the sleeve in place on the main loop member, in such a manner that if tools are used to forcibly move the sleeve 132 to one side, in order to remove one or more keys from the ring, tool marks will be permanently and irreversibly made on the sleeve member 132, alerting a user that tampering has occurred.

Referring again to FIG. 4, it will be seen that a unique serial ID number 40 may also be stamped in, laser-etched on to, or otherwise applied to the key ring 120, if desired. Where used, the serial ID number 40 may be placed either on the sleeve member 132, on the main loop member 122, or on both of these components.

Adjacent to the grooves 125, 127, the main loop member 22 may also have a pair of sleeve alignment indicators 140, 142 formed thereon to guide a user in aligning the tubular sleeve member 132 with the main loop member 122. The alignment indicators 140, 142 are spaced apart by a distance which is substantially equal to the length of the sleeve 132, as shown.

Each of the first and second ends 124, 126 of the main loop member 122 can include a rounded or chamfered edge portion 149, to facilitate insertion of the ends of the main loop member 22 into the tubular sleeve member 32.

Kit

Either of the first or second embodiments of the present invention may be manufactured and sold as a kit, where the kit includes the main loop member 22 or 122 along with the corresponding sleeve member 32 or 132. One such kit is shown in FIGS. 7A and 7B, and includes the main loop member 122 and the sleeve member 132 separate and disconnected from one another. After a user buys such a kit, the user may place one or more keys on the main loop member, and then may attach the sleeve member to the main loop member with a crimping tool, as previously described, to form the assembled key ring.

Method of Use

The present invention also encompasses a method of using the key ring 20 or 120 hereof.

Figure 5:
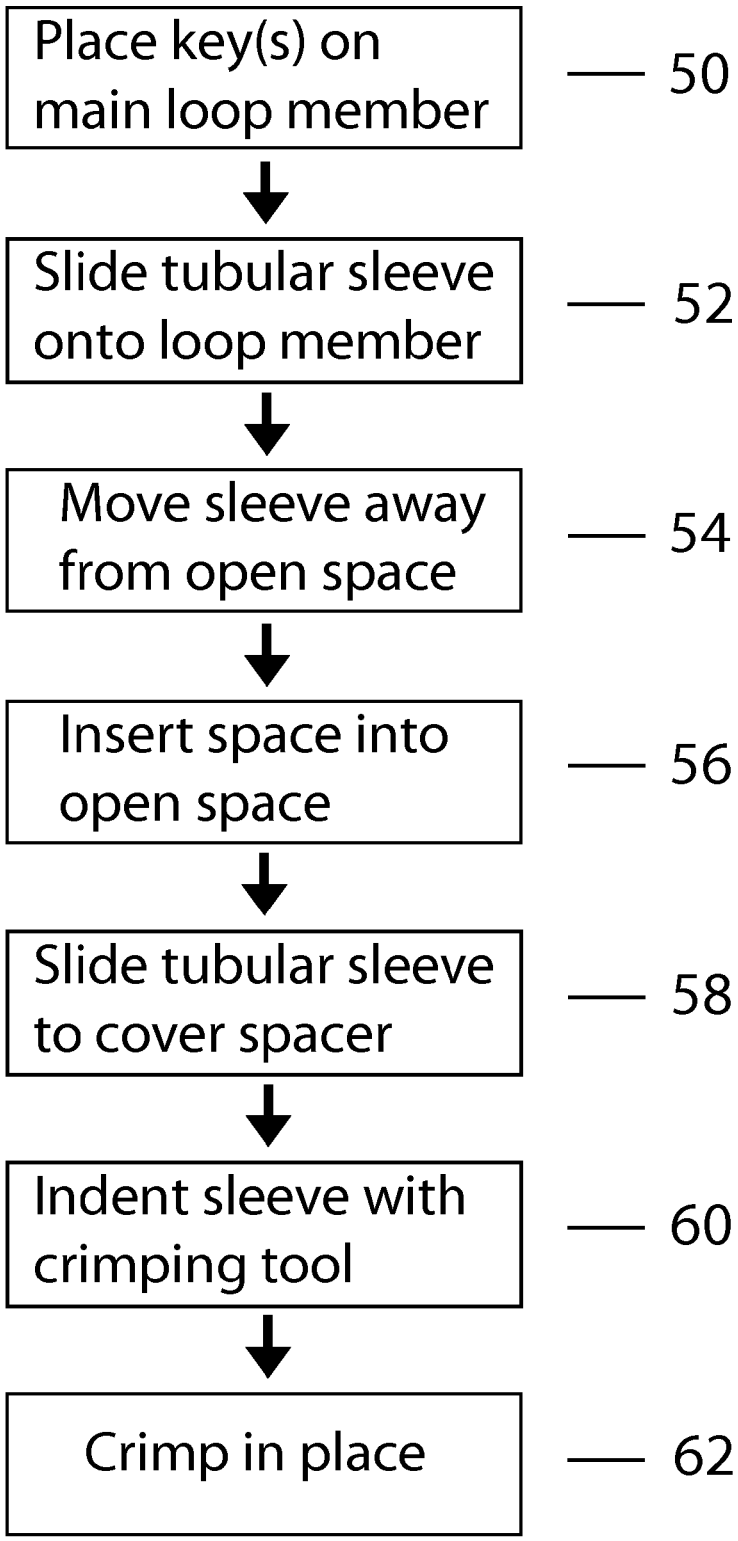
FIG. 5 is a chart showing steps required in a method of assembling the key ring and crimping the sleeve in place.
Figure 6:
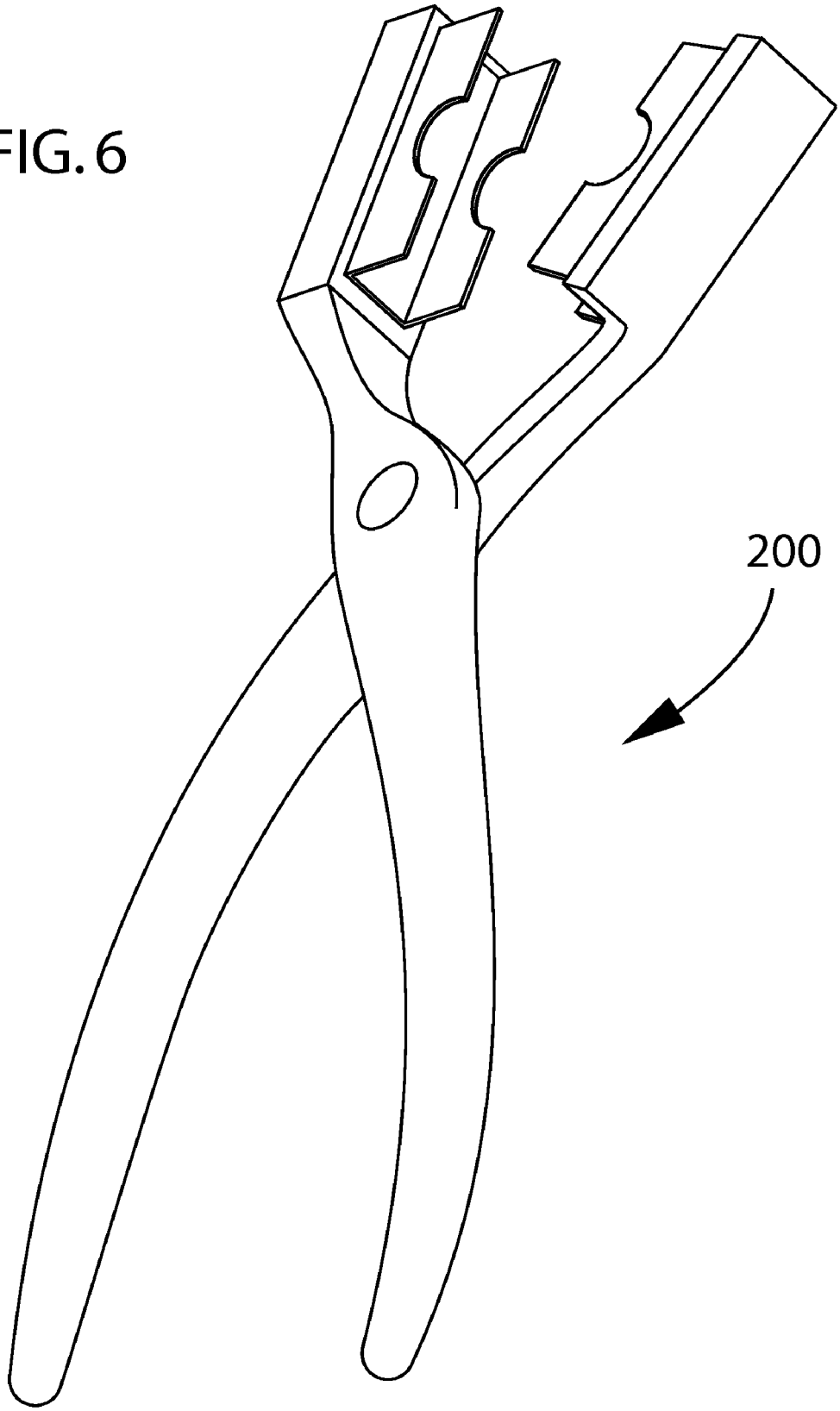
FIG. 6 is a perspective view of an alternate crimping mechanism which is usable with the key ring hereof.

Referring now to FIG. 5, a first step 50 of an exemplary method according to the invention involves mounting a key (not shown) on a main loop member 22 formed from a substantially rigid material, where the loop member includes a first end portion 24 having a first diameter and a second end portion 26 disposed adjacent the first end portion with an open space 28 therebetween. As noted above, the second end portion 26 has a diameter which is substantially equal to the first diameter "d" and each of the first and second end portions 24, 26 has a respective groove 25, 27 formed therein.

A second step 52 of the exemplary method according to the invention involves sliding a tubular sleeve member having a hollow passage formed therethrough on to one of the first or second end portions of the main loop member, and slidably moving the sleeve member away from the open space between the end portions of the main loop. As previously noted, the tubular sleeve 32 has a pair of crimping location indicators thereon to suggest crimping areas for applying a crimping tool thereto.

A third, optional step 54 of the exemplary method according to the invention involves placing a spacer which has a diameter which is substantially equal to the first diameter into the open space between the first and second end portions of the main loop member.

A fourth step 56 of the exemplary method according to the invention involves slidably moving the sleeve member to cover the end portions of the main loop.

A fifth step 58 of the exemplary method according to the invention involves making a respective indentation in each area of the sleeve member having a crimping location indicator thereon, using a crimping tool; and A sixth step 60 of the exemplary method according to the invention involves pressing a first of the indentations toward a corresponding groove formed in the first end portion of the main loop member, and pressing a second of the indentations toward a corresponding groove formed in the second end portion of the main loop member, in order to firmly connect the sleeve member to the main loop member, and so that at least one area of the key ring will be visually marked by subsequent forcible separation of the sleeve member from either of the two end portions.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. One example of a modification which may be made is that the spacer 30 may be omitted, and the first and second end portions 24, 26 of the main loop member 22 may be placed closely adjacent one another, with the main loop member being made sufficiently flexible that it may be stretched or bent to temporarily form enough space between the end portions 24, 26 to allow for installation of the sleeve 32 thereon. All such modifications, which are within the scope of the claims, are intended to be within the scope and spirit of the present invention.

Having, thus, describe the invention, what is claimed is:

1. A key ring apparatus configured to provide visual evidence of tampering in the event that tampering occurs, said key ring apparatus comprising:

a main loop member including a first end portion having a first diameter and a second end portion for placement adjacent to the first end portion with an open space therebetween, the second end portion having a diameter which is substantially equal to the first diameter, each of said first and second end portions having a respective groove formed circumferentially therein and a respective sleeve alignment indicator thereon adjacent the groove; and a tubular sleeve member having a hollow passage formed therethrough to receive the end portions of the main loop member, said tubular sleeve member having a pair of spaced-apart crimping location indicators thereon to suggest crimping areas for applying a crimping tool thereto;

wherein when the sleeve member is slidably installed on the main loop member, the ends of the sleeve member are alignable with the sleeve alignment indicators to correspondingly align the crimping location indicators of the sleeve member with the underlying grooves of the main loop member.

2. The key ring apparatus of claim 1, further comprising a spacer having a diameter which is substantially equal to the first diameter, the spacer having a size which is configured to fit into the open space between the first and second end portions of the main loop member.

3. The key ring of claim 1, wherein each of the crimping location indicators and the sleeve alignment indicators, respectively, comprises an additional groove.

4. The key ring apparatus of claim 1, wherein the main loop member has a unique identification code thereon.

5. The key ring apparatus of claim 1, wherein the tubular sleeve member has a unique identification code thereon.

6. The key ring apparatus of claim 1, wherein the groove of each of the end portions of the main loop member includes an inner side wall having a beveled face, a bottom wall defining a recessed annular surface, and an outer side wall which is substantially perpendicular to the bottom wall, as viewed in cross-section.

7. The key ring apparatus of claim 1, wherein the main loop member includes a first end portion and a second end portion interconnected by an arcuate connecting portion.

8. The key ring apparatus of claim 1, wherein each of the first and second end portions includes a substantially straight part configured to slidably receive part of the sleeve member thereon, and wherein the substantially straight part of the first end portion is longer than the substantially straight part of the second end portion.

9. A key ring apparatus configured to provide visual evidence of tampering in the event that tampering occurs, said key ring apparatus comprising:

a main loop member formed from a substantially rigid material, the main loop member including a first end portion having a first diameter and a second end portion disposed adjacent to the first end portion with an open space therebetween, the second end portion having a diameter which is substantially equal to the first diameter, each of said first and second end portions having a respective groove formed circumferentially therein, and each of said first and second end portions having a sleeve alignment indicator formed circumferentially therearound adjacent the groove for guiding a user in aligning the sleeve and the main loop member; and a tubular sleeve member having a hollow passage formed therethrough to receive the end portions of the main loop member, said tubular sleeve member having a pair of spaced-apart crimping location indicators thereon to suggest crimping areas for applying a crimping tool thereto;

wherein when the sleeve member is slidably installed on the main loop member, the ends of the sleeve member are alignable with the sleeve alignment indicators to correspondingly align the crimping location indicators of the sleeve member with the underlying grooves of the main loop member.

10. The key ring apparatus of claim 9, wherein each of the sleeve alignment indicators and the crimping location indicators, respectively, comprises an additional groove.

11. The key ring apparatus of claim 9, wherein the main loop member has a unique identification code thereon.

12. The key ring apparatus of claim 9, wherein the tubular sleeve member has a unique identification code thereon.

13. The key ring apparatus of claim 9, wherein the groove of each of the end portions of the main loop member includes an inner side wall having a beveled face, a bottom wall defining a recessed annular surface, and an outer side wall which is substantially perpendicular to the bottom wall, as viewed in cross-section.

14. The key ring apparatus of claim 9, wherein each of the first and second end portions includes a substantially straight part configured to slidably receive part of the sleeve member thereon, and wherein the substantially straight part of the first end portion is longer than the substantially straight part of the second end portion.

15. The key ring apparatus of claim 9, wherein each of the first and second end portions includes a chamfered edge portion.

16. A method of fixing a key on a key ring apparatus configured to provide visual evidence of tampering, said method comprising the steps of:

a) mounting a key on a main loop member formed from a substantially rigid material, said main loop member including a first end portion having a first diameter and a second end portion disposed adjacent to the first end portion with an open space therebetween, said second end portion having a diameter which is substantially equal to the first diameter, each of said first and second end portions having a respective groove formed therein;

b) sliding a tubular sleeve member having a hollow passage formed therethrough on to one of said first and second end portions of said main loop member, and slidably moving said sleeve member away from said open space between the end portions of the main loop member, said tubular sleeve having a pair of crimping location indicators thereon to suggest crimping areas for applying a crimping tool thereto;

c) slidably moving said sleeve member to cover the end portions of the main loop member and to align the ends of the sleeve member with alignment marks formed on the first and second end portions of the main loop member adjacent the grooves, and thereby align the indicators of the sleeve member with the underlying grooves of the main loop member;

d) making a respective indentation in each area of the sleeve member having a crimping location indicator thereon; and e) pressing a first of said indentations toward a corresponding groove formed in the first end portion of the main loop member, and pressing a second of said indentations toward a corresponding groove formed in the second end portion of the main loop member, in order to firmly connect the sleeve member to the main loop member so that at least one area of the key ring apparatus will be visually marked by any subsequent separation of the sleeve member from either of the two end portions.

17. The method of claim 16, including the further step of placing a spacer which has a diameter that is substantially equal to the first diameter into the open space between the first and second end portions of the main loop member prior to the step of slidably moving.

18. A kit for use in fabricating a key ring apparatus configured to provide visual evidence of tampering in the event that tampering occurs, said kit comprising:

a main loop member including a first end portion having a first diameter and a second end portion for placement adjacent to the first end portion with an open space therebetween, the second end portion having a diameter which is substantially equal to the first diameter, each of said first and second end portions having a respective groove formed circumferentially therein and a respective sleeve alignment indicator thereon adjacent the groove; and a tubular sleeve member having a hollow passage formed therethrough to receive the end portions of the main loop member, said tubular sleeve member having a pair of spaced-apart crimping location indicators thereon to suggest crimping areas for applying a crimping tool thereto;

wherein the tubular sleeve member is separate from the main loop member;

and wherein when the sleeve member is slidably installed on the main loop member, the ends of the sleeve member are alignable with the alignment marks to correspondingly align the indicators of the sleeve member with the underlying grooves of the main loop member.

19. The key ring of claim 9, wherein the length of the first end portion is sufficient to permit the sleeve to be slidably installed thereon and moved a sufficient distance past the open space to permit a user to install one or more keys on the main loop member.

20. The key ring of claim 1, wherein the first end includes a substantially straight first end portion having a length sufficient to permit the sleeve to be slidably installed thereon and moved a sufficient distance past the open space to permit a user to install one or more keys on the main loop member.

* * * * *